US006312157B1

(12) United States Patent
Masuda et al.

(10) Patent No.: US 6,312,157 B1
(45) Date of Patent: Nov. 6, 2001

(54) PACKAGING BAGS AND METHOD OF PRODUCING SAME

(76) Inventors: Tokihisa Masuda, 1730-11 Oaza Sakata, Okegawa Saitama; Masatoshi Imanaka, 3-31-14-803 Sendagi, Bunkyo-ku Tokyo, both of (JP)

( * ) Notice: Subject to any disclaimer, the term of this patent is extended or adjusted under 35 U.S.C. 154(b) by 0 days.

(21) Appl. No.: 09/670,763

(22) Filed: Sep. 27, 2000

(30) Foreign Application Priority Data

Oct. 15, 1999 (JP) ..... 11-293761

(51) Int. Cl.[7] ..... B65D 33/24
(52) U.S. Cl. ..... 383/98; 383/86; 383/99
(58) Field of Search ..... 383/84, 86, 98, 383/99, 907, 9; 229/87.01

(56) References Cited

U.S. PATENT DOCUMENTS

| | | | | |
|---|---|---|---|---|
| 2,327,024 | * | 8/1943 | Davidson, Jr. et al. | 229/87.01 |
| 2,836,344 | * | 5/1958 | Gatward | 383/98 X |
| 2,896,639 | * | 7/1959 | Barnes et al. | 383/98 X |
| 2,948,457 | * | 8/1960 | Thiele | 383/98 |
| 2,992,768 | * | 7/1961 | Gatward | 383/98 X |
| 3,493,166 | * | 2/1970 | Smith et al. | 383/86 X |

FOREIGN PATENT DOCUMENTS

| | | | | |
|---|---|---|---|---|
| 0148834 | * | 2/1952 | (AU) | 383/98 |
| A0732283 | * | 9/1960 | (FR) | 383/84 |
| 0510372 | * | 8/1939 | (GB) | 383/98 |
| 1124757 | * | 8/1968 | (GB) | 383/99 |
| 404189753-A | * | 7/1992 | (JP) | 383/99 |

* cited by examiner

*Primary Examiner*—Jes F. Pascua
(74) *Attorney, Agent, or Firm*—Coudert Brothers.

(57) ABSTRACT

Packaging bags are produced by cutting a larger material sheet into individual portions and folding each of these individual pieces to form a main body having a front wall, a back wall, side walls which stand up from a flat bottom. A lid for closing the upper opening is uniformly sloped upward from the front wall to the back wall. A ridge is formed, extending upward from the back wall, for sealing the bag closed. A trapezoidally folded flap extends upward from the back wall and is folded forward over the seal ridge. A pair of fastening tapes is used to keep the flap detachably attached to the seal ridge such that the bag, after it is once opened, can be closed again. Instead of the fastening tapes, an elongated member serving like a belt loop may be used to keep the flap retractably inserted under it to keep the flap closed.

11 Claims, 5 Drawing Sheets

PACKAGING BAGS AND METHOD OF PRODUCING SAME

BACKGROUND OF THE INVENTION

This invention relates to bags for making packages for different kinds of products such as potato chips, candies, cereal foods, salt, sugar and detergents.

As a trend in the modern world, more people are eating light snacks. As a result, enormous amounts of snack foods such as potato chips are being sold and consumed daily. When such snack foods are purchased by the consumer, they are usually packaged in laminated package bags, or package bags of different kinds such as the so-called pillow type, quadrangularly sealed type or standing paunch type. When the products thus differently packaged are transported by a wholesaler to retail stores, the shipments are usually made in corrugated fibreboard boxes, each box filled either mechanically or manually with a specified number of filled packaging containers. Because prior art types of packaging containers invariably include so-called dead spaces, these boxes become unnecessarily bulky. Since this inevitably affects the cost of transportation, there have been attempts to reduce the dead space as much as possible. Containers in the shape of a rectangular parallelopiped may be considered advantageous because they can be tightly packed inside a box and do not rattle too much when being transported but they tend to make their contents to appear too small. Other disadvantages of this type include that only a limited amount of articles can be packaged inside and that the packaged products are likely to be damaged.

In view of the above, Japanese Utility Model No. 2593457, Japanese Patent No. 7-293012 and U.S. Pat. No. 5,570,569 (issued Nov. 5, 1996 to Masuda) disclosed a packaging container as generally shown at 101 in FIG. 11, characterized as being made of a soft packaging material in the shape of a generally rectangular column (with a front wall 102, a back wall 103 and side walls 104) as well as a planar bottom and a uniformly sloped upper lid 106. These containers have been popular in the market because they can be packed efficiently inside a fiberboard box or the like, as shown in FIG. 12, and the dead space between the containers can be reduced as closely to zero as possible.

The package container 1 shown above is formed from a single sheet of soft packaging material by folding it forward and backward. After the sloped lid 106 is formed, the back wall 103 is made taller than the highest part of the sloped lid 106, protruding further above. This portion has no practical function and used to be cut off, and this amounted to a waste of material.

SUMMARY OF THE INVENTION

It is therefore an object of this invention to provide package bags with improved opening part.

It is another object of this invention to provide such packaging bags which can be transported efficiently.

It is still another object of this invention to provide such packaging bags which can be easily opened and closed again.

It is a further object of this invention to provide such packaging bags of which even the upwardly protruding back wall portion can be utilized for the closing.

It is a still further object of this invention to provide such packaging bags that can be produced economically by cutting a single larger material sheet into individual smaller sheets each for producing one of these bags.

Packaging bags embodying this invention, with which the above and other objects can be accomplished, may be each characterized as being produced by folding a single foldable material sheet and comprising not only a main body having a front wall, a back wall, side walls which stand up from a flat bottom and a lid which is uniformly sloped upward from the front wall to the back wall to close the bag but also a trapezoidally folded flap which extends upward from the back wall and is folded forward to form a seal ridge where the bag is initially sealingly closed and also to close the bag so as to be easily reopened by means, for example, of fastening tapes of a known kind or of belt-loop like member under which the tip of the flap can be retractably inserted.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 3:
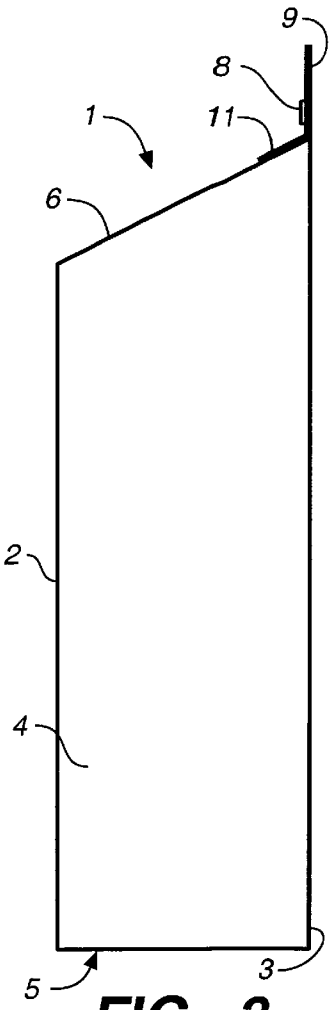
FIG. 3 is a side view of the packaging bag of FIGS. 1 and 2.
Figure 2:
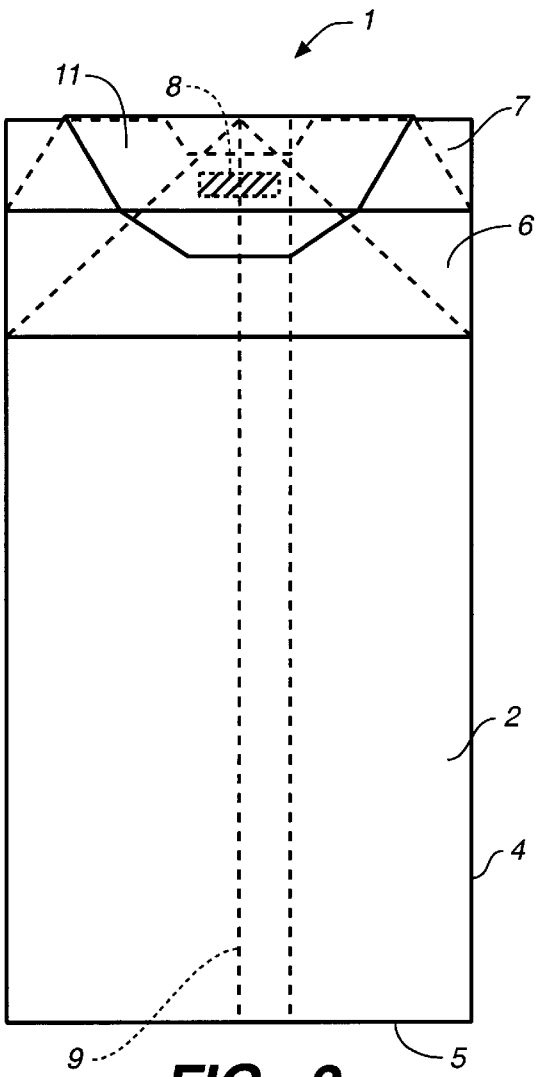
FIG. 2 is a front view of the packaging bag of FIG. 1.
Figure 1:
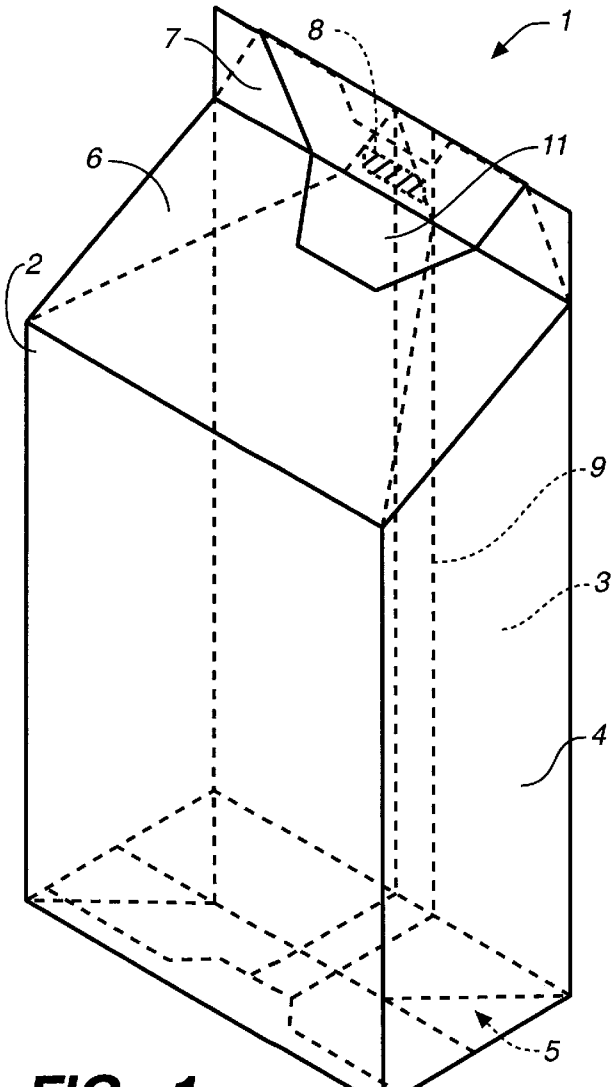
FIG. 1 is a diagonal transparent view of a packaging bag according to a first embodiment of the invention.

The invention is described next by way of examples. FIGS. 1–3 show a packaging bag 1 according to a first embodiment of this invention, FIG. 1 being its diagonal transparent view, FIG. 2 being its front view and FIG. 3 being its side view. Described broadly, the packaging bag 1 has a columnar body with a rectangular cross-sectional shape, having a front wall 2, a back wall 3 and side walls 4 which stand up from a flat rectangular bottom 5, and a lid 6 which, when closed, slopes uniformly downward from the back wall 3 to the front wall 2. If the bag 1 contains a food item which is not consumed entirely in one sitting, it is desirable that the user be able to re-close the bag 1 after it is once opened. For this purpose, there is provided at the top a portion referred to as the "seal ridge 7". The seal ridge 7 is where the bag is first sealed to be closed, extending upward from where the lid 6 reaches the back wall 3, and a trapezoidally shaped flap 11 extends further upward from the seal ridge 7 and is folded forward thereover. The flap 11 and the seal ridge 7 are each provided with a fastening tape 8 (such as a Velcro (trademark) tape), as will be described more in detail below, such that the bag can be re-closed and re-opened after it is first opened at the seal ridge 7.

Figure 4:
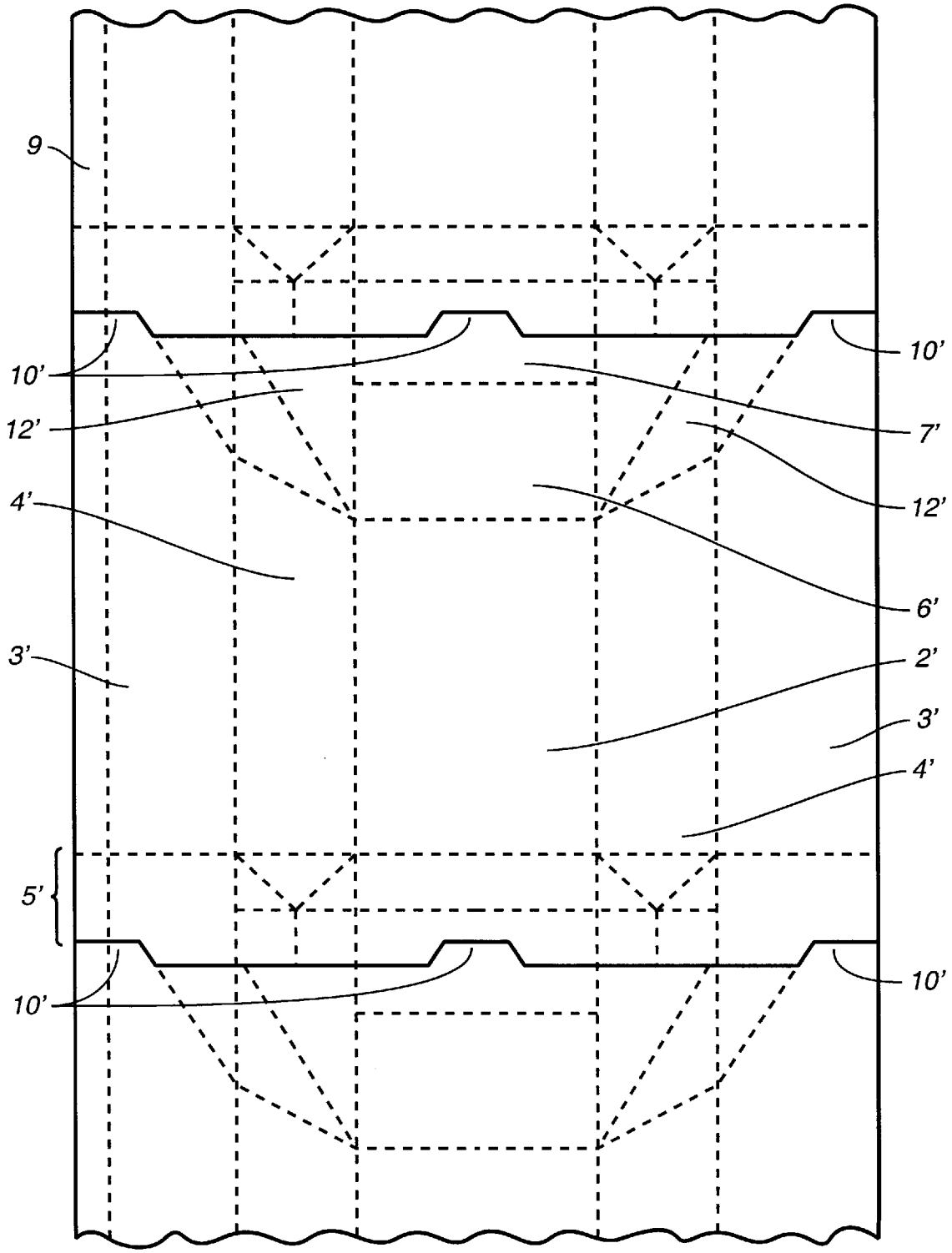
FIG. 4 is a plan view of a sheet from which packaging bags as shown in FIGS. 1–3 are produced.

Packaging bags, each generally described above with reference to FIGS. 1–3, may be produced from a single sheet ("material sheet") of a suitable bag-making material such as a laminated synthetic resin or paper material, as shown in FIG. 4, by cutting along solid lines to prepare individual portions each for producing one of the bags 1 by folding along broken lines. It is to be noted in this connection, however, that the cutting need not be done before the folding. It is also to be noted that no part of the material sheet will be wasted when it is cut into the individual portions because these individual portions are designed and arranged on the original material sheet, as shown in FIG. 4, in such a way that each mutually adjacent pair of these individual portions is separated by and both abutting a single common boundary line without having any waste area therebetween.

For the convenience of explanation, a method of forming a bag from one of the individual portions of the material sheet shown in FIG. 4 (after it is cut) will be explained next. For the convenience of description, furthermore, the fastening tapes 8 will not always be shown in the figures to follow. In FIG. 4, the broken lines indicate where the sheet is to be folded, without regard to the direction (inward or outward) in which it is to be folded and some of the individual areas separated by these folding lines are indicated by the same numerals but with a prime as the parts of the bag 1 shown in FIGS. 1–3 are to be formed. For example, the area which becomes the front wall 2 after the sheet is folded is indicated as the "front wall part 2".

Figure 5:
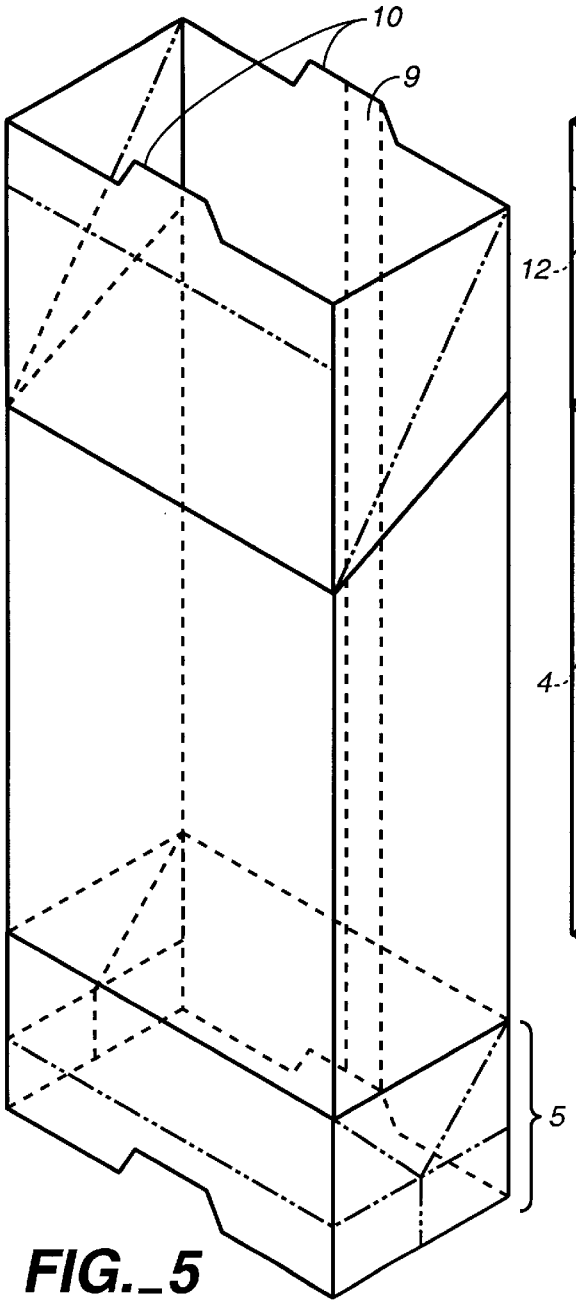
FIG. 5 is a diagonal transparent view of the packaging bag of FIGS. 1–3 when it is being produced from a portion of the sheet shown in FIG. 4 into a tubular form.

First, the material sheet is folded along the parallel vertical broken lines separating the front wall part 2', side wall parts 4' and back wall parts 3' (as shown in FIG, 4) into a tubular form with a rectangular sectional shape, as shown in FIG. 5 with the top and bottom still remaining open. In FIG. 5 and thereafter, corresponding portions are indicated by the same numeral as in FIGS. 1–3. Both side edges 9 (extending vertically as shown in FIG. 5) of the back wall parts 3' are sealed together to complete the tubular form. The invention does not impose any particular requirement on the manner in which these side edges 9 are vertically sealed together. Any known method of so-called longitudinal sealing in the technical field of bag making such as by a form-fill-seal type packaging machine may be utilized. The packaging bag 1 according to this embodiment may be further characterized as having upward protrusions 10 (or the "tabs") from the top edge of the portion of this tubular form from which the back wall 3 and the upper lid 6 are later to be formed. It may be noted in FIG. 4 that corresponding protrusions 10' (or the "tab parts") are already present when the material sheet is cut into individual portions.

Figure 6:
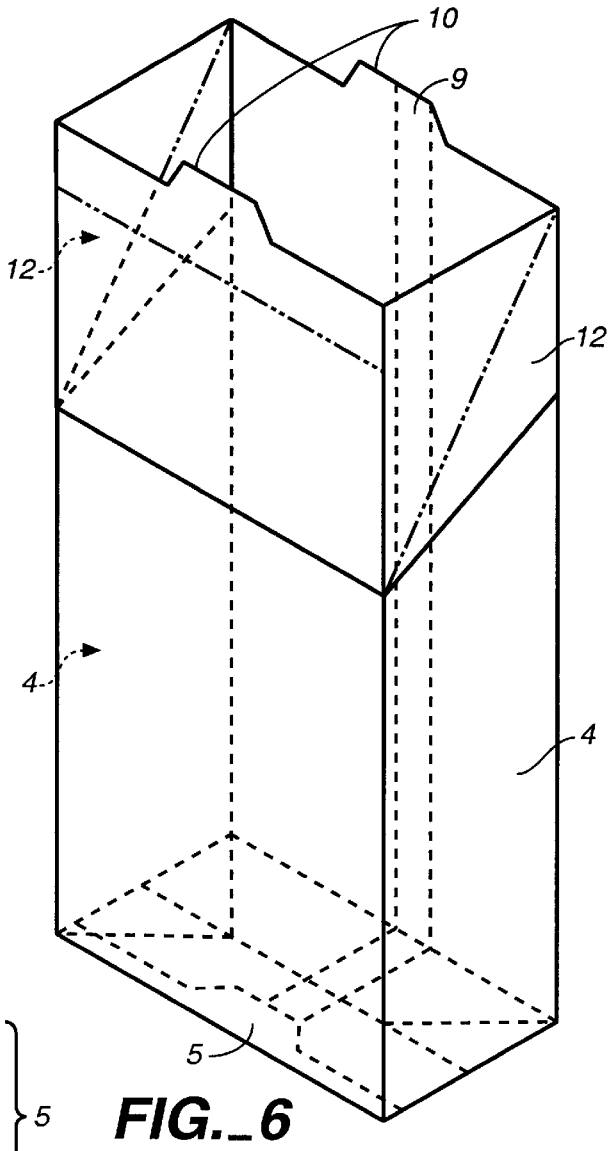
FIG. 6 is a diagonal transparent view of the packaging bag of FIGS. 1–3 when it is being produced after the bottom portions of the tubular form of FIG. 5 have been folded into a bag-shaped structure.

Bottom portions of the tubular form shown in FIG. 5, corresponding to bottom parts 5' of FIG. 4 adjacent to and extending downward from the front wall part 2', the side wall parts 4' and the back wall parts 3' are folded along the broken lines and sealed together (thermally by a heat sealing method, for example) to form the flat bottom 5 of the bag 1, thereby making the tubular form of FIG. 5 into a bag-shaped structure with a top opening as shown in FIG. 6.

Figure 9:
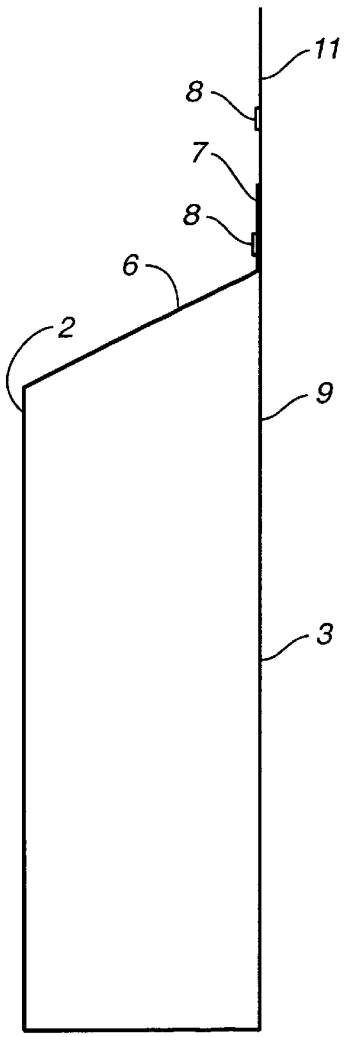
FIG. 9 is a side view of the structure shown in FIG. 7.
Figure 8:
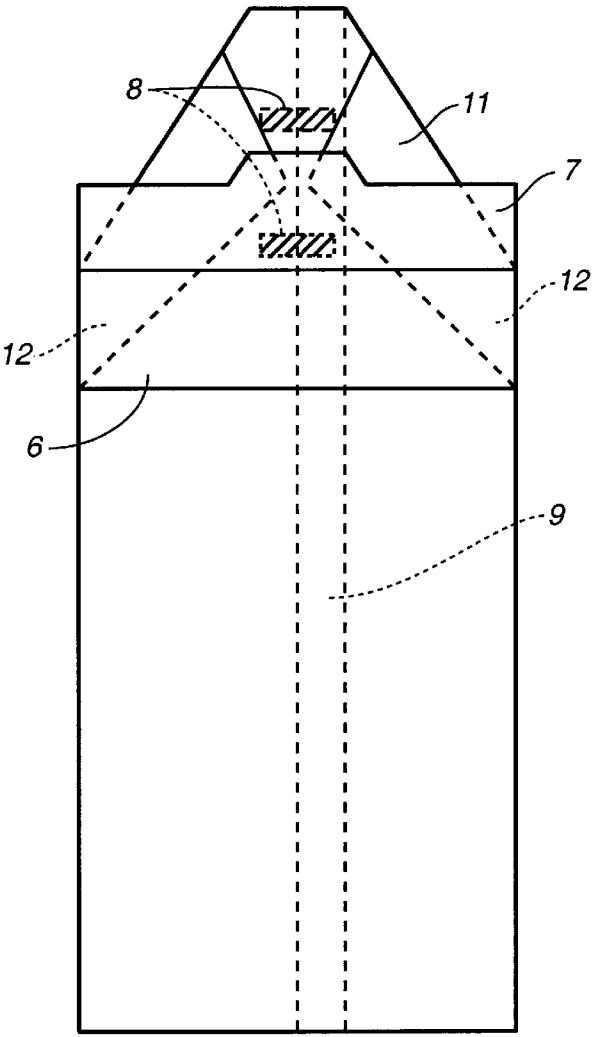
FIG. 8 is a front view of the structure shown in FIG. 7.
Figure 7:
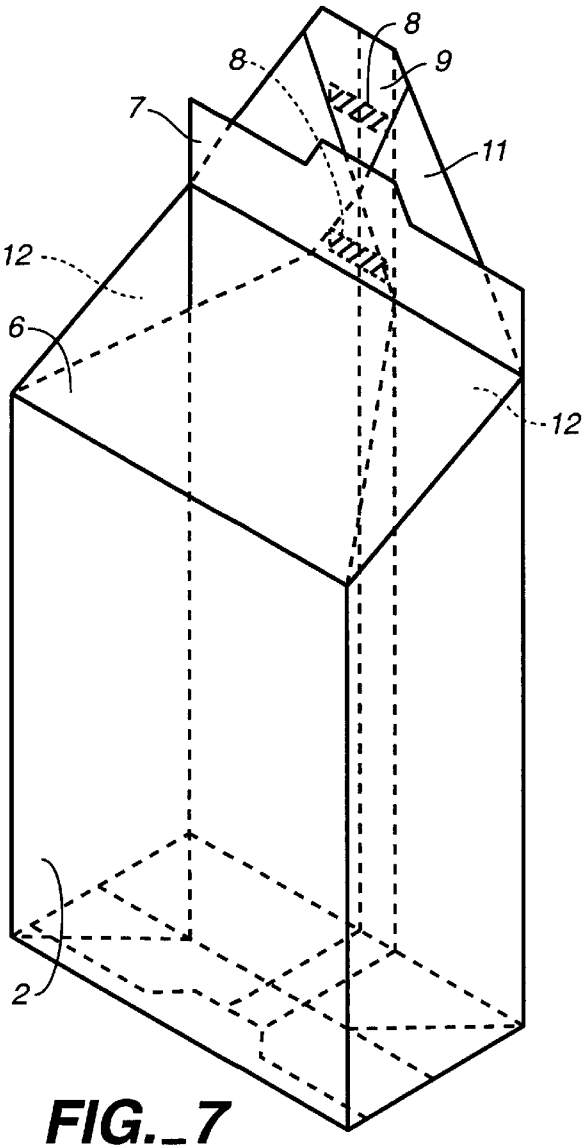
FIG. 7 is a diagonal transparent view of the packaging bag of FIGS. 1–3 when it is being produced after the top portions of the bag-shaped structure of FIG. 6 have been folded to form the top lid.

Next, after articles to be packaged (not shown) are dropped inside this bag-shaped structure, top parts of the walls 2–4 of this bag-shaped structure are folded along dotted lines shown in FIG. 6 to form the forwardly sloped lid 6, as shown in FIGS. 7, 8 and 9 (in which the fastening tapes 8 are shown again), extending uniformly upwardly sloped from the front wall 2 to the back wall 3, as well as a trapezoidally folded flap 11 extending upward from the back wall 2. The portion of the material sheet which becomes the lid 6 is indicated in FIG. 4 as the "lid part 6". It is to be noted that the seal ridge 7 is actually formed by sealing an upward extension of the lid 6, folded therefrom, onto a bottom portion of the flap 11 and above the back wall 3 to close the bag. The portion of the material sheet which corresponds to this upward extension of the lid 6 and thus becomes the seal ridge 7 is indicated in FIG. 4 as the "seal ridge part 7".

The portions of this bag-shaped structure shown in FIG. 6 above the side walls 4 (indicated by numerals 12 and corresponding to the portions of the material sheet indicated in FIG. 4 by 12') are hereinafter referred to as the "upper folded parts". Each of the upper folded parts 12 is connected to and folded from both the lid 6 and a corresponding one of the side walls 4. As the lid 6 is folded backward from the front wall 2 such that the seal ridge 7 is sealed and the bag is closed, the upper folded parts 12 are themselves folded inward (along diagonal broken lines shown in FIG. 6) below the lid 6. It is to be noted that the tab 10 protruding upward from the back wall as shown in FIG. 6 becomes the top end of the flap 11 as shown in FIGS. 7–9, as the portion of the material sheet above the back wall part 3' is folded diagonally to produce the trapezoidal flap 11. The tab part 10' protruding upward from the seal ridge part 7' becomes the tab 10 protruding above the front wall 2 in FIG. 6. As the bag is initially closed and the seal ridge 7 is sealed as shown in FIGS. 7–9, however, this tab 10 is not sealed to the material of the flap 11. Thus, the user can grab and pull this tab 10 when opening the bag. In other words, the tab 10 is formed according to this embodiment of the invention for the convenience of the user when the bag 1 is to be opened.

As explained above and shown now in FIGS. 7–9, the flap 11 and the seal ridge 7 are each provided with a fastening tape 8. These fastening tapes 8 may be attached to the material sheet at appropriate positions in the seal ridge part 7' and the back wall part 3' (although not shown in FIG. 4). The trapezoidal flap 11 thus formed is folded forward over the seal ridge 7, as shown in FIGS. 1–3, such that the two fastening tapes 8 attach to each other, detachably attaching the flap 11 to the seal ridge 7, or re-closing the bag which has been opened such that it can be re-opened easily.

Figure 10:
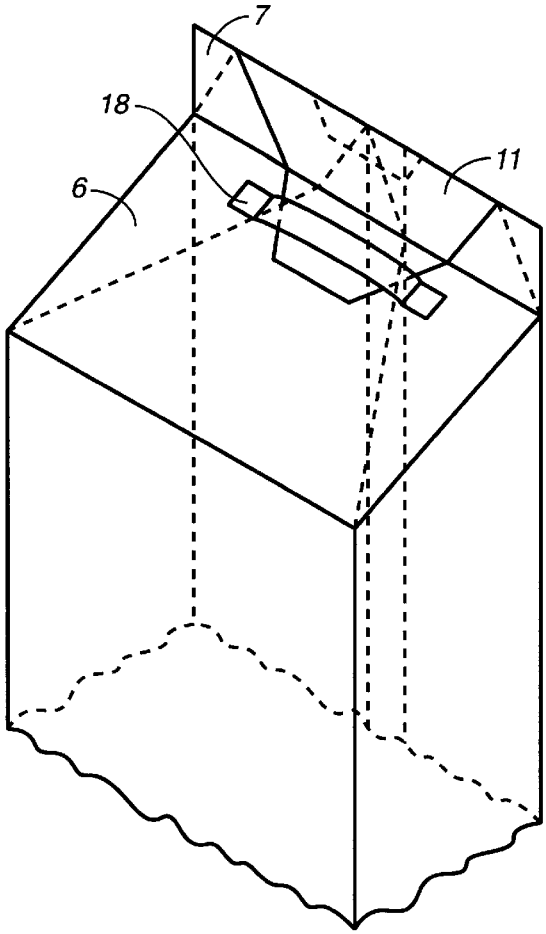
FIG. 10 is a diagonal view of a portion of another packaging bag according to a second embodiment of the invention.
Figure 11:
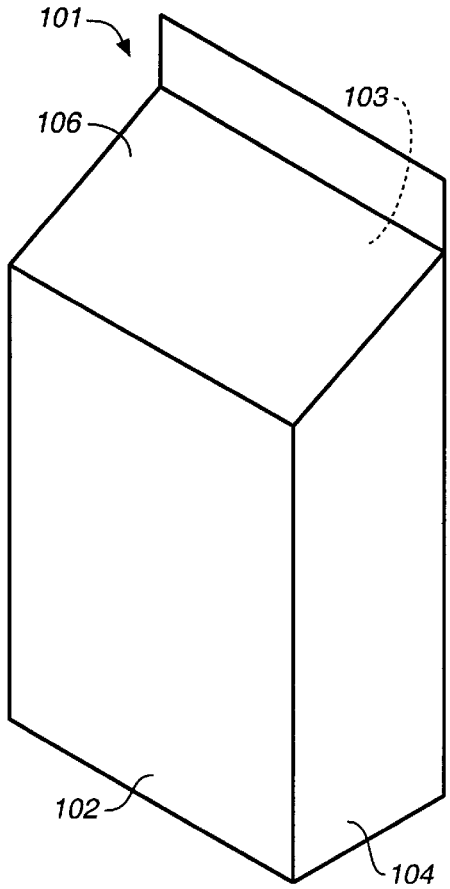
FIG. 11 (PRIOR ART)
FIG. 11 is a diagonal view of a prior art packaging bag.
Figure 12:
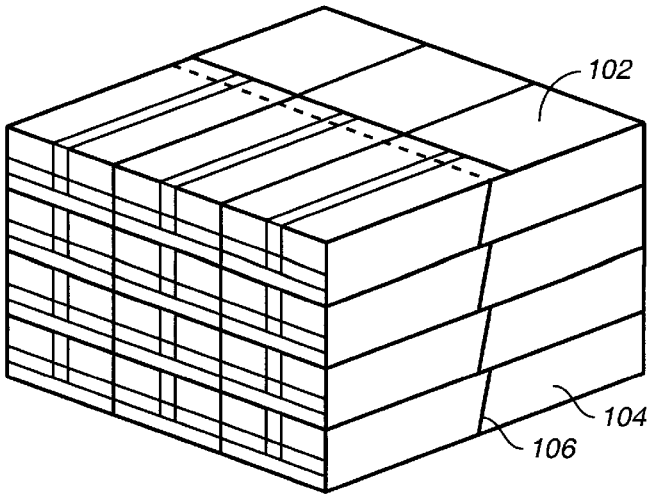
FIG. 12 (PRIOR ART)
FIG. 12 is a diagonal view of prior art packaging bags as shown in FIG. 11 stacked up inside a box for transportation.

The first embodiment of the invention, by way of which the invention has been described above, is not intended to limit the scope of the invention. Many modifications and variations are possible within the scope of the invention. For example, the tabs 10, although convenient when opening the bag, are not essential. If tabs 10 are to be eliminated, as can be understood easily from FIG. 4, each bag can be formed by folding a completely rectangular sheet without any protrusions representing the tabs. As another example, fastening tapes need not be used to re-close the bag after it is opened once. As schematically shown in FIG. 10, an elongated member 18 may be attached to an upper part on the outer surface of the lid 6 at both ends such that it can function like a belt loop and the top end of the trapezoidally shaped flap 11, after being folded forward over the seal ridge 7 as explained above with reference to the first embodiment of the invention, can be inserted under this elongated belt loop-like member 18 to keep the bag closed, allowing it to be easily re-opened by pulling and thereby disengaging the flap 11.

As already mentioned, the physical properties of the material sheet are not intended to limit the scope of the invention as long as the sheet is flexible enough to be foldable. Many kinds of material have been known for making such bags, depending on the nature of the articles to be packaged and, for example, whether protection against moisture is very important or not. Neither is the position of the longitudinal sealing intended to limit the scope of the invention. Although the longitudinal sealing was shown to take place along the center vertical line of the back wall, the longitudinal sealing may be effected along one of the side walls. In summary, the disclosure is intended to be interpreted broadly.

What is claimed is:

1. A packaging bag made of a foldable sheet, said packaging bag comprising:

a main body having a front wall, a back wall, side walls and a flat bottom, said front, back and side walls being folded from said bottom and standing up from said bottom to together form a box-shaped structure with a quadrangular sectional shape and a top opening;

a lid which is uniformly sloped upward from said front wall to said back wall to close said top opening and is folded from said front wall;

a seal ridge extending upward from said back wall where said bag is sealed;

a trapezoidal flap which is made trapezoidal by folding said sheet, extends from said seal ridge and is folded over said seal ridge; and engaging means for releasably keeping said trapezoidal flap in an engaged position to keep said bag closed.

2. The packaging bag of claim 1 wherein said main body, said lid and said trapezoidal flap are formed by folding a single sheet of a foldable material having a specified shape.

3. The packaging bag of claim 1 wherein said engaging means comprise a pair of fastening tapes, one of said tapes being attached to said trapezoidal flap, and the other of said tapes being attached to said seal ridge, said pair of fastening tapes being disengageably engageable with each other.

4. The packaging bag of claim 2 wherein said engaging means comprise a pair of fastening tapes, one of said tapes being attached to said trapezoidal flap, and the other of said tapes being attached to said seal ridge, said pair of fastening tapes being disengageably engageable with each other.

5. The packaging bag of claim 1 wherein said engaging means comprise an elongated member with ends thereof attached to said lid such that said trapezoidal part is retractably insertable between said elongated member and said lid.

6. The packaging bag of claim 2 wherein said engaging means comprise an elongated member with ends thereof attached to said lid such that said trapezoidal part is retractably insertable between said elongated member and said lid.

7. The packaging bag of claim 1 further comprising a tab serving to be pulled to open said bag, said tab being integral with and protrudes from said lid and said seal ridge.

8. The packaging bag of claim 2 wherein said back wall comprises two separate portions of said material sealed together.

9. The packaging bag of claim 2 wherein said sheet is one of a plurality of sheets each having said specified shape, said specified shape being such that said plurality of sheets can be arranged sequentially, each mutually adjacent pair of said plurality of sheets being separated by and both abutting a single boundary line without having any area therebetween.

10. The packaging bag of claim 2 further comprising upper folded parts, each of said upper folded parts being connected and integrally extending from both said lid and a corresponding one of said side walls and being folded and attached to said lid.

11. The packaging bag of claim 10 wherein portions of said foldable sheet which are each adjacent to and folded from a corresponding one of said upper folded parts are attached to and form part of said seal ridge when said bag is sealed.

* * * * *